US005703314A

United States Patent [19]

Meeker

[11] Patent Number: 5,703,314

[45] Date of Patent: Dec. 30, 1997

[54] INFRARED PROJECTOR COUNTERMEASURE SYSTEM

[75] Inventor: Delbert Brent Meeker, Camarillo, Calif.

[73] Assignee: The United States of America as represented by the Secretary of the Navy, Washington, D.C.

[21] Appl. No.: 752,779

[22] Filed: Nov. 20, 1996

[51] Int. Cl.[6] ..... G01J 1/00

[52] U.S. Cl. ..... 89/1.11; 250/495.1; 342/14

[58] Field of Search ..... 89/1.11; 250/495.1; 244/3.16; 342/14

[56] References Cited

U.S. PATENT DOCUMENTS

| | | | |
|---|---|---|---|
| 3,766,858 | 10/1973 | Handler et al. | 102/37.6 |
| 3,841,219 | 10/1974 | Schillreff | 102/37.6 |
| 4,439,767 | 3/1984 | Hafley et al. | 89/36.01 |
| 4,624,186 | 11/1986 | Widera et al. | 102/336 |
| 5,070,790 | 12/1991 | Parquier | 102/513 |
| 5,166,507 | 11/1992 | Davis et al. | 250/201.9 |
| 5,378,155 | 1/1995 | Eldridge | 434/11 |
| 5,563,420 | 10/1996 | Sullivan et al. | 250/504 |
| 5,600,434 | 2/1997 | Warm et al. | 89/1.11 |

*Primary Examiner*—Michael J. Carone
*Assistant Examiner*—Christopher K. Montgomery
*Attorney, Agent, or Firm*—Melvin J. Sliwka; David S. Kalmbaugh

[57] ABSTRACT

A countermeasure system, adapted for use on board an aircraft, for confusing an incoming missile as to the location and heading of the aircraft. The countermeasure system generates for each side of the aircraft at least two infrared energy images which are projected onto the aircraft's fuselage and then swept across the aircraft's fuselage to confuse the incoming missile's infrared seeker. Each infrared energy image is generated by at least two lasers operating at different frequencies within the infrared region of the electromagnetic spectrum. A beam combiner combines the beams of infrared energy from each laser forming a single collimated beam of infrared energy having multiple frequencies which is then directed to a beam former. The beam former spreads the collimated beam of infrared energy which it then directs to a scanner. The scanner, which is mounted in a wing tip pod on the aircraft, directs the collimated beam to the fuselage of the aircraft sweeping the beam of infrared energy over the fuselage of the aircraft to confuse the infrared seeker of the incoming missile as to the flight path of the aircraft.

11 Claims, 2 Drawing Sheets

INFRARED PROJECTOR COUNTERMEASURE SYSTEM

BACKGROUND OF THE INVENTION

1. Field of the Invention

The present invention relates generally to countermeasures systems. More specifically, the present invention relates to a countermeasure system, adapted for use on an aircraft, which projects at least one beam of collimated infrared energy on the body of the aircraft to deceive an incoming missile as to the present location and flight path of the aircraft.

2. Description of the Prior Art

It is well known that current state of the art missiles have the capability of homing on targets, such as enemy aircraft, ships or other targets, which emit infrared energy. Generally, these missiles employ imaging seekers, which sense the infrared energy from the target, to track and then destroy the target.

Generally, infrared radiation emitting decoy projectiles are used to deceive an incoming missile as to the location and heading of the target. These decoy projectiles are, for example, carried on targets such as aircraft or ships so that when the target's detection instruments detect the approach of an incoming missile equipped with an infrared search system a decoy projectile can be fired into the air. Subsequently, at a predetermined height and distance from the target, the decoy projectile will ignite and eject combustible flakes which burn and emit infrared radiation. These combustible flakes from the decoy form a burning interference cloud which descends slowly toward the earth's surface diverting the incoming missile toward the interference cloud and away from the target.

Modern, imaging infrared seekers can distinguish between a localized, point source of radiation provided by a flare and the distributed, complex radiation pattern of an aircraft structure. This capability is one of the reasons for using an imaging infrared seeker on a missile when tracking an aircraft.

When protection of very rapidly moving targets is involved, state of the art imaging infrared seekers used in missiles scan for multiple frequencies in the infrared region of the electromagnetic spectrum. This renders the decoy projectiles ineffective since the interference cloud generated by the projectiles or even a flare generally have a characteristic frequency spectrum which can be distinguished from that of an aircraft.

Accordingly, it is an object of the present invention to provide a highly effective countermeasure system.

It is another object of the present invention to provide a countermeasure system for providing protective cover for an aircraft or the like against homing devices operating upon infrared reflected energy.

It is still another object of the present invention to provide a countermeasure system including means for dispensing infrared reflected energy which confuses an infrared homing device on board a missile or the like.

The above and other novel features and advantages of the present invention and the manner of realizing them will become more apparent and the invention will be best understood from a study of the following description and appended claims, with reference to the attached drawings.

SUMMARY OF THE INVENTION

According to the present invention, briefly stated, there is provided a countermeasure system, adapted for use on board an aircraft or the like which confuses an incoming missile as to the motion, location and heading of the aircraft. The countermeasures system of the present invention generates, for each side of the aircraft, at least two infrared energy spots or images which are projected onto the aircraft's fuselage and then swept across the aircraft's fuselage to confuse the incoming missile's homing device.

Each infrared energy image is generated by at least two lasers operating at different frequencies within the infrared region of the electromagnetic spectrum. A beam combiner combines the beams of infrared energy beam from each laser forming a single collimated beam of infrared energy having multiple frequencies which is then directed to a beam former. The beam former spreads the collimated beam of infrared energy which it then directs to a scanner.

The scanner, which is mounted in a wing tip pod on the aircraft directs the beam to the fuselage of the aircraft sweeping the beam of infrared energy over the fuselage of the aircraft to confuse the infrared seeker of the incoming missile as to the flight path of the aircraft.

DETAILED DESCRIPTION OF THE PREFERRED EMBODIMENT

Figure 1:
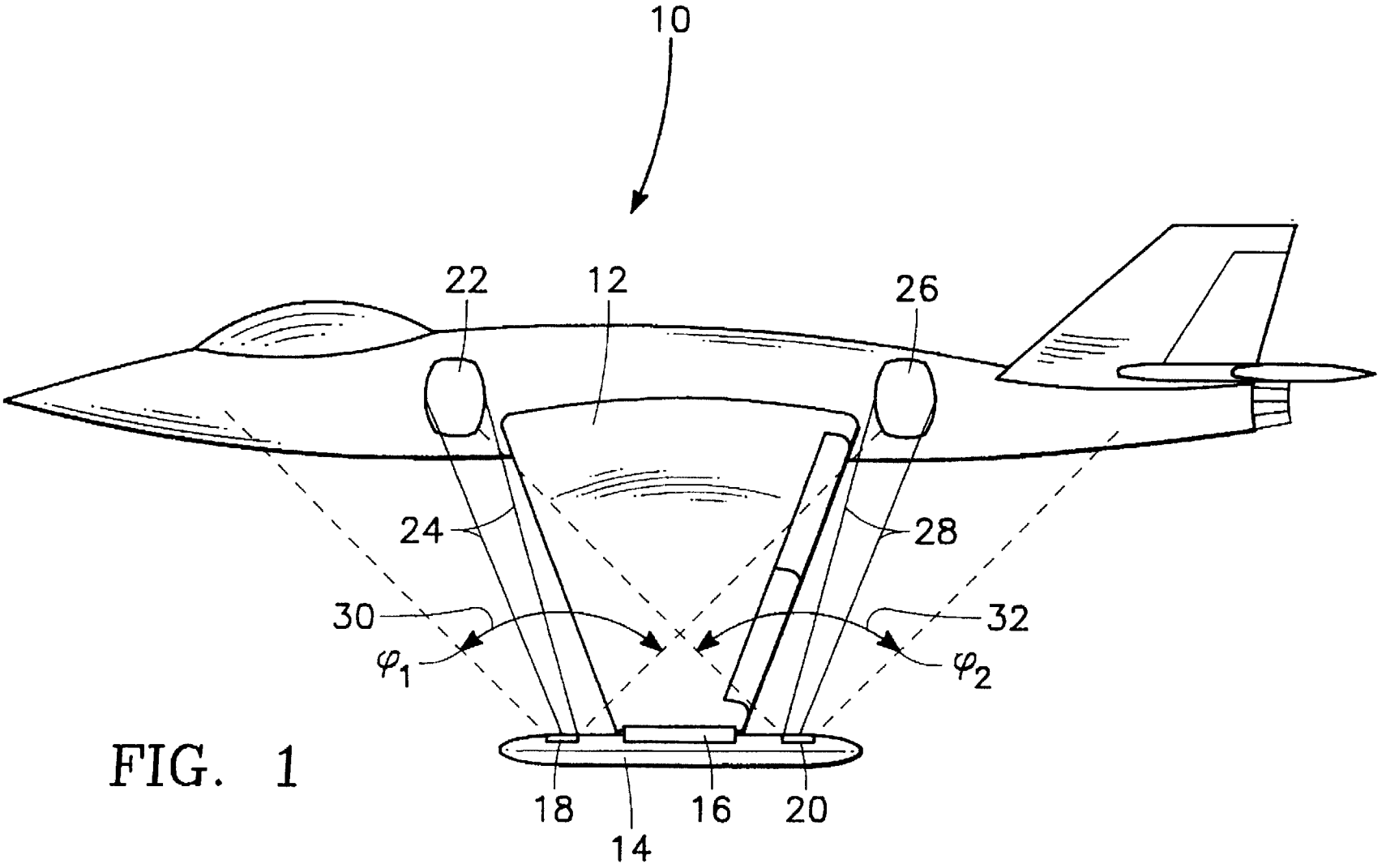
FIG. 1 illustrates a perspective view of an aircraft utilizing the present invention.

Referring now to FIG. 1, there is an aircraft, designated generally by the reference numeral 10, which may be, for example, a military jet or other aircraft capable of traveling at supersonic speeds. Aircraft 10 includes a wing 12 which has affixed to its underside a wing tip pod 14. The wing tip pod 14 is secured to wing 12 by a launcher mechanism 16 or other support assembly which may be used to receive an aircraft weapons systems such as a sidewinder missile. The wing tip pod 14 is adapted to house at least one countermeasure system 40 (illustrated in FIG. 2) which is used to deceive incoming missiles with infrared energy homing devices launched from an enemy aircraft, ship or other launching vehicle.

It should be noted that the opposite wing of aircraft 10 may also have a wing tip pod 14 affixed thereto so that aircraft 10 has at least one countermeasure system 10 on each side of the aircraft to confuse an incoming missile irregardless of the flight of the missile.

Figure 2:
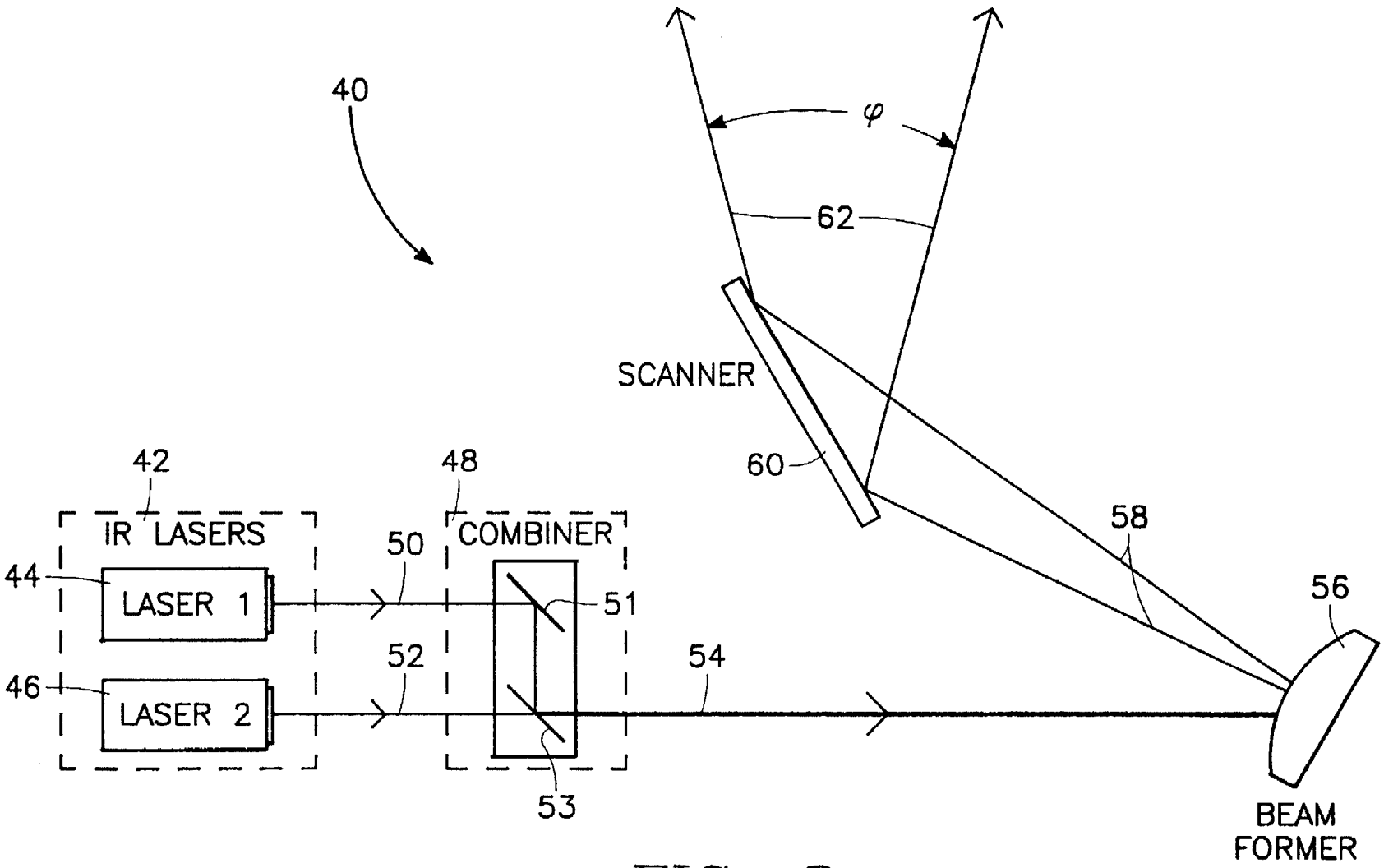
FIG. 2 is schematic diagram illustrating a preferred embodiment of the present invention.

Referring to FIGS. 1 and 2, the countermeasure system 40 includes a plurality of infrared lasers, designated generally by the reference numeral 42, each of which generates a collimated beam of infrared energy or radiation in the frequency range where the wavelength is approximately four to five microns. While the system illustrated in FIG. 2 uses only two infrared lasers 44 and 46, it should be understood that the present invention may require the use of three or more lasers operating at different frequencies within the infrared region of the electromagnetic spectrum to effectively deceive the homing device or seeker of an incoming missile.

Laser 44 of countermeasure system 40 generates a collimated beam of infrared energy 50 which is projected along a first optical or light path to a mirror 51 of a beam combiner 48. Mirror 51 reflects the collimated beam of infrared energy at an angle of approximately ninety degrees to a mirror 53 of beam combiner 48. Mirror 53 is transparent to infrared energy directed to its rear surface and reflective to infrared energy directed to its front surface.

Laser 46 of countermeasure system 40 also generates a collimated beam of infrared energy 52 which is projected along a second optical path to mirror 53 of beam combiner 48.

Lasers 44 and 46 each emit a narrow spectral band of infrared energy requiring at least two lasers operating at different frequencies within the infrared energy of the electromagnetic spectrum to effectively deceive the infrared homing device or infrared seeker on the missile which generally will look for more than one spectral band within the infrared region to distinguish the target from background radiation or flares. Thus, the collimated beam of infrared energy 52 from laser 46 is set at a frequency which is different than the frequency of the collimated beam of infrared energy 50 from laser 44.

The collimated beam of infrared energy 50 is reflected by mirror along the second optical path while the collimated beam of infrared energy 52 passes through mirror 53 along the second optical path. This results in the formation of a collimated beam of infrared energy 54 having multiple frequencies which is then directed along the second optical path to a beam former 56.

If it is desired, for example, to deceive a missile using an infrared homing device or seeker which detects three frequencies within the infrared region of the electromagnetic spectrum then countermeasure system 10 would use three lasers operating at different frequencies to generate beam 54. Beam combiner 48 would also be modified using additional mirrors to combine the beams in the manner illustrated in FIG. 2 and described above.

In a like manner, if there is a requirement to deceive a missile using an infrared homing device or seeker which detects four frequencies within the infrared region of the electromagnetic spectrum then countermeasure system 10 would use four lasers operating at different frequencies to generate beam 54. Beam combiner 48 would also have to be modified in the manner described above to accommodate four separate infrared laser beams operating at different frequencies within the infrared region of the electromagnetic spectrum.

Beam former 56 may be a convex mirror which spreads beam 54 setting its width to a desired value to form beam 58 which is then directed along a third optical path to a scanner 60. The angle which beam former 56 spreads beam 54 may be up to fifteen degrees which is generally adequate to sufficiently illuminate a portion of the fuselage of aircraft 12 so that the homing device of an incoming missile is confused as to the flight path of aircraft 12.

Scanner 60 may be, for example, a mirror or a highly reflective metallic surface which will reflect incoming infrared energy forming beam 62.

Scanner 60 directs beam 62, through a window 18 in wing tip pod 14 to the fuselage of aircraft 10. Scanner 60 also includes a drive system (not illustrated) which controls movement of scanner 60 such that scanner 60 will project beam 62 in a lateral sweep or lateral sweeping motion across the fuselage of aircraft 10. The drive system may include at least one drive motor to scan beam 62 across the fuselage of aircraft 10; control electronics to control the drive motor; and an on board computer to generate the signals required by the control electronics to cause movement of scanner 60 across the fuselage of aircraft 10.

Referring to FIG. 1, the wing tip pod 14 of aircraft 10 includes a pair of countermeasure systems 40 (FIG. 2), the first of the pair of countermeasure systems 40 being located in the front portion of wing tip pod 14 and the second of the pair of countermeasure systems 40 being located in the rear portion of wing tip pod 40. Although not illustrated in FIG. 1 the wing tip pod on the opposite wing of aircraft 10 would also have a pair of countermeasure systems 40 (FIG. 1).

The countermeasure systems 40 located in the front portion of wing tip pod 14 projects a beam 24 of infrared energy through window 18 of wing tip pod 14 onto the fuselage of aircraft 10. The infrared energy image 22 formed by beam 24 on the fuselage of aircraft 10 is a substantially circular shaped spot of infrared energy having multiple frequencies. Scanner 60 (FIG. 2) moves beam 24 and thus infrared energy image 22 across the fuselage of aircraft 10 through a sweep angle $\phi_1$ (as depicted by arrow 30 in FIG. 1).

In a like manner, the countermeasure systems 40 located in the rear portion of wing tip pod 14 projects a beam 28 of infrared energy through window 20 of wing tip pod 14 onto the fuselage of aircraft 10. The infrared image 26 formed by beam 28 on the fuselage of aircraft 10 is also a substantially circular shaped spot of infrared energy having multiple frequencies. Scanner 60 (FIG. 2) moves beam 28 and thus infrared image 26 across the fuselage of aircraft 10 through a sweep angle $\phi_2$ (as depicted by arrow 32 in FIG. 1).

Movement of infrared energy images or spots 22 and 26 in the manner described above will generally confuse an infrared homing device or seeker on a missile since the missile's infrared homing device or seeker tracks a line of sight rate for the target aircraft. The movement of infrared energy images 22 and 26 will cause an incoming missile to swerve which alters its flight path and thus the missile will miss its intended target aircraft.

In a like manner, the opposite side of aircraft 12 (not illustrated in FIG. 1) would have two infrared energy spots moving across the aircraft's fuselage to confuse a missile approaching aircraft 12 on the aircraft's opposite side.

It should be noted that the infrared beam 62 provided by countermeasure system 40 which is depicted in FIG. 2 is the same as beams 24 and 28 illustrated in FIG. 1. It should also be noted that the lasers 44 and 46 should be high powered lasers such as carbon dioxide lasers. This results in a reflective intensity in the order 1–5 watts per steradian.

From the foregoing, it may readily be seen that the present invention comprises a new, unique and exceedingly useful countermeasure system for deceiving an incoming missile as to the present location and heading of target which constitutes a considerable improvement over the known prior art. Obviously, many modifications and variations of the present invention are possible in light of the above teachings. It is therefore to be understood that within the scope of the appended claims that the invention may be practiced otherwise than as specifically described.

What is claimed is:

1. A countermeasure system adapted for use on board an aircraft to confuse an infrared seeker of an incoming missile as to a flight path for said aircraft, said countermeasure system being mounted in a wing tip pod of said aircraft, said countermeasure system comprising:

a plurality of laser beam generating means, each of said laser beam generating means generating a collimated beam of infrared energy having a predetermined frequency, the predetermined frequency of said collimated beam of infrared energy generated by one of said plurality of laser beam generating means being different from the predetermined frequency of said collimated beam of infrared energy generated by another of said plurality of laser beam generating means;

beam combining means disposed from said plurality of laser beam generating means to receive and then combine said collimated beam of infrared energy generated by each of said plurality of laser beam generating means to provide a multiple frequency collimated beam of infrared energy, said beam combining means projecting said multiple frequency collimated beam of infrared energy along a first optical path;

beam forming means spatially disposed from said beam combining means on said first optical path, said beam forming means spreading said multiple frequency collimated beam of infrared energy to a predetermined angle to provide a substantially circular shaped multiple frequency beam of infrared energy, said beam forming means projecting said substantially circular shaped multiple frequency beam of infrared energy along a second optical path;

scanning means spatially disposed from said beam forming means on said second optical path to receive said substantially circular shaped multiple frequency beam of infrared energy, said scanning means projecting said substantially circular shaped multiple beam of infrared energy in a lateral sweeping motion across a fuselage of said aircraft.

2. The countermeasure system of claim 1 wherein said plurality of laser beam generating means comprises at least a first laser and a second laser.

3. The countermeasure system of claim 1 wherein each of said plurality of laser beam generating means comprises a carbon dioxide laser.

4. The countermeasure system of claim 1 wherein said collimated beam of infrared energy generated by each of said plurality of laser beam generating means has a wavelength which is in a range of four to five microns.

5. The countermeasure system of claim 1 wherein said predetermined angle said beam forming means spreads said multiple frequency collimated beam of infrared energy is about fifteen degrees.

6. The countermeasure system of claim 1 wherein said beam forming means comprises a convex mirror.

7. A countermeasure system adapted for use on board an aircraft to confuse an infrared seeker of an incoming missile as to a flight path for said aircraft, said countermeasure system being mounted in a wing tip pod of said aircraft, said countermeasure system comprising:

a first laser for projecting a first collimated beam of infrared energy along a first optical path, said first collimated beam of infrared energy having a first frequency;

a second laser for projecting a second collimated beam of infrared energy along said first optical path, said second collimated beam of infrared energy having a second frequency;

a beam combiner spatially disposed from said first laser and said second laser to receive said first collimated beam of infrared energy and said second collimated beam of infrared energy, said beam combiner combining said first and said second collimated beams of infrared energy to form a third collimated beam of infrared energy having said first and said second frequencies, said beam combiner projecting said third collimated beam of infrared energy along said first optical path;

a beam former spatially disposed from said beam combiner on said first optical path, said beam former spreading said third collimated beam of infrared energy to a predetermined angle to provide a substantially circular shaped beam of infrared energy having said first and said second frequencies, said beam former projecting said substantially circular shaped beam of infrared energy along a second optical path; and a scanner spatially disposed from said beam former on said second optical path to receive said substantially circular shaped beam of infrared energy, said scanner projecting said substantially circular shaped beam of infrared energy in a lateral sweeping motion across a fuselage of said aircraft.

8. The countermeasure system of claim 7 wherein each of said first and said second lasers comprise a carbon dioxide laser.

9. The countermeasure system of claim 7 wherein said predetermined angle said beam former spreads said third collimated beam of infrared energy is about fifteen degrees.

10. The countermeasure system of claim 7 wherein said beam former comprises a convex mirror.

11. The countermeasure system of claim 7 wherein said first collimated beam of infrared energy and said second collimated beam of infrared energy each have a wavelength which is in a range of four to five microns.

* * * * *